US011454399B2

(12) United States Patent
Paller et al.

(10) Patent No.: US 11,454,399 B2
(45) Date of Patent: Sep. 27, 2022

(54) BAKE ALGORITHM FOR GAS OVEN WITH ELECTRIC BAKE ELEMENT

(71) Applicant: Haier US Appliance Solutions, Inc., Wilmington, DE (US)

(72) Inventors: Hans Juergen Paller, Louisville, KY (US); Rebekah Leigh Tyler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/951,084

(22) Filed: Nov. 18, 2020

(65) Prior Publication Data

US 2022/0154933 A1 May 19, 2022

(51) Int. Cl.

| | |
|---|---|
| ***F24C 1/04*** | (2021.01) |
| ***H05B 1/02*** | (2006.01) |
| ***F24C 3/12*** | (2006.01) |
| ***F24C 7/08*** | (2006.01) |

(52) U.S. Cl.

CPC ..... *F24C 1/04* (2013.01); *F24C 3/128* (2013.01); *F24C 7/085* (2013.01); *H05B 1/0263* (2013.01)

(58) Field of Classification Search

CPC ..... F24C 1/04; F24C 15/322

USPC ..... 219/398, 413, 446.1, 483

See application file for complete search history.

(56) References Cited

U.S. PATENT DOCUMENTS

| | | | | |
|---|---|---|---|---|
| 7,759,617 | B2 | 7/2010 | Bowles et al. | |
| 8,563,901 | B2 | 10/2013 | Hitchcock et al. | |
| 8,776,776 | B2 | 7/2014 | Todd et al. | |
| 2003/0015518 | A1* | 1/2003 | Baker | F24C 7/087 219/486 |
| 2006/0090741 | A1* | 5/2006 | Bowles | F24C 1/04 126/41 R |
| 2008/0264406 | A1* | 10/2008 | Burtea | A21B 1/02 126/39 BA |
| 2011/0108017 | A1 | 5/2011 | Todd et al. | |

FOREIGN PATENT DOCUMENTS

| | | |
|---|---|---|
| EP | 1847780 B1 | 10/2009 |

* cited by examiner

*Primary Examiner* — Thien S Tran
(74) *Attorney, Agent, or Firm* — Dority & Manning, P.A.

(57) ABSTRACT

A method of operating an oven appliance includes obtaining a temperature set point, determining, based on the temperature set point, an electric heating temperature range and a gas undershoot temperature limit, the gas undershoot limit being below the electric heating temperature range, determining that a chamber temperature of the oven appliance has dropped to the gas undershoot temperature limit, and operating a gas heat source to maintain the chamber temperature above the gas undershoot temperature limit.

18 Claims, 4 Drawing Sheets

BAKE ALGORITHM FOR GAS OVEN WITH ELECTRIC BAKE ELEMENT

FIELD OF THE INVENTION

The present subject matter relates generally to oven appliances, and more particularly to baking algorithms for oven appliances having more than one type of burner.

BACKGROUND OF THE INVENTION

Oven appliances generally include one or more heating elements to provide heat to a cooking chamber to cook food. Generally, the heating element(s) are electric heating elements or gas heating elements. In the case of an electric heating element, a voltage is supplied to the electric heating element which then emits heat to the cooking chamber. In the case of a gas heating element, a gas fuel is supplied to a burner in or near the cooking chamber, which is then ignited and burned to provide heat to the cooking chamber.

However, electric heating elements require a large voltage input to heat heavy loads. Further, gas heating elements may provide uneven heating throughout a cooking chamber, leading to improperly cooked items or longer cooking times. A need exists for an oven appliance that provides fast, thorough, even cooking. Additionally or alternatively, a need exists for an oven appliance in a situation where a voltage input is limited.

Accordingly, an oven appliance that obviates one or more of the above-mentioned drawbacks would be beneficial. Particularly, a method of operating an oven appliance incorporating an electric heating element and a gas heating element would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating an oven appliance is provided. The method may include obtaining a temperature set point, determining, based on the temperature set point, an electric heating temperature range and a gas undershoot temperature limit, the gas undershoot limit being below the electric heating temperature range, determining that a chamber temperature of the oven appliance has dropped to the gas undershoot temperature limit, and operating a gas heat source to maintain the chamber temperature above the gas undershoot temperature limit.

In another exemplary aspect of the present disclosure, an oven appliance is provided. The oven appliance may include a cabinet defining a cooking chamber, an electric heat source provided within the cooking chamber, a gas heat source provided within the cooking chamber, a temperature sensor provided within the cooking chamber and configured to sense a temperature of the cooking chamber, and a controller operably connected to the electric heat source, the gas heat source, and the temperature sensor. The controller may execute an operation comprising obtaining a temperature set point, determining, based on the temperature set point, an electric heating temperature range and a gas undershoot temperature limit, the gas undershoot limit being below the electric heating temperature range, determining that a chamber temperature has dropped to the gas undershoot temperature limit, and operating the gas heat source to maintain the chamber temperature above the gas undershoot temperature limit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
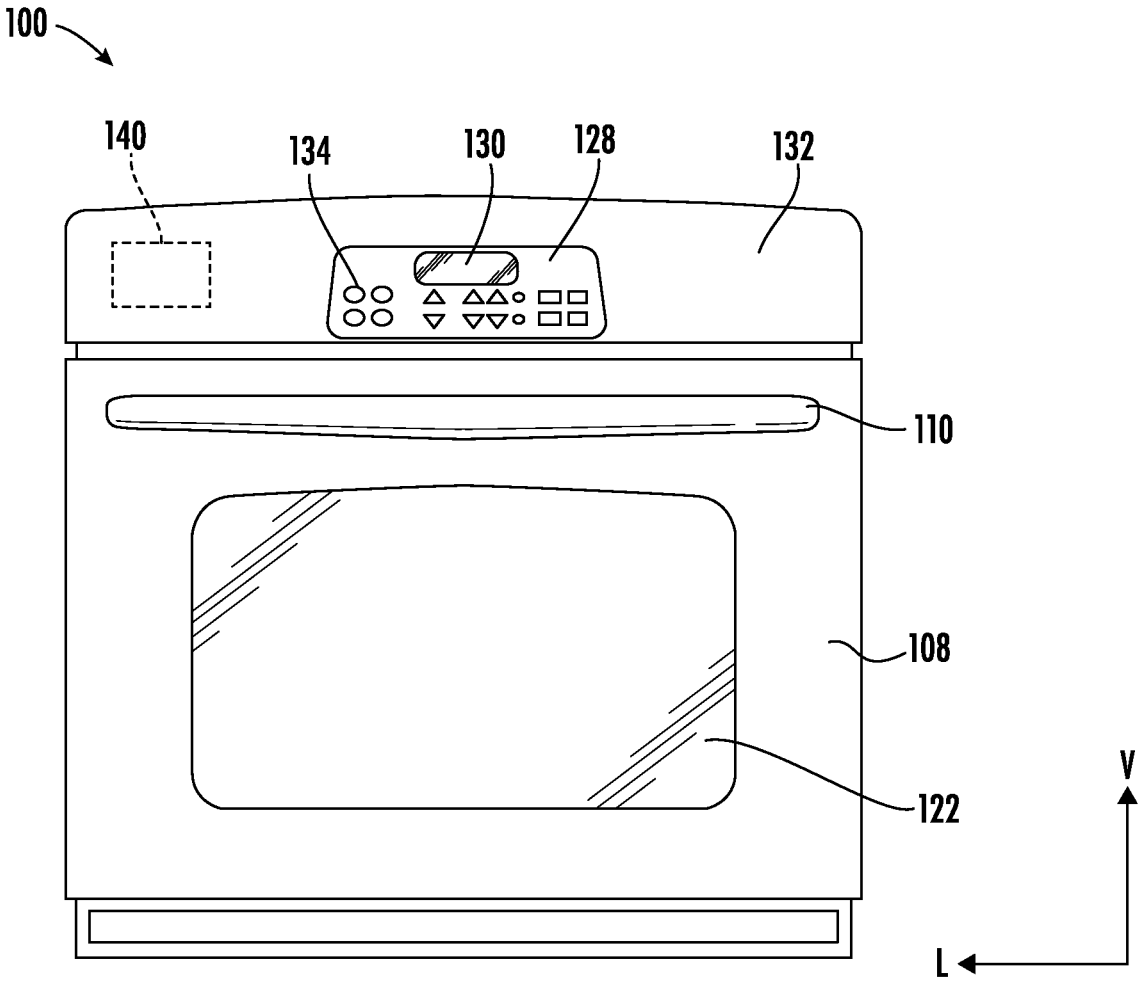
FIG. 1 provides a front view of an exemplary oven appliance with the door in a closed position according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
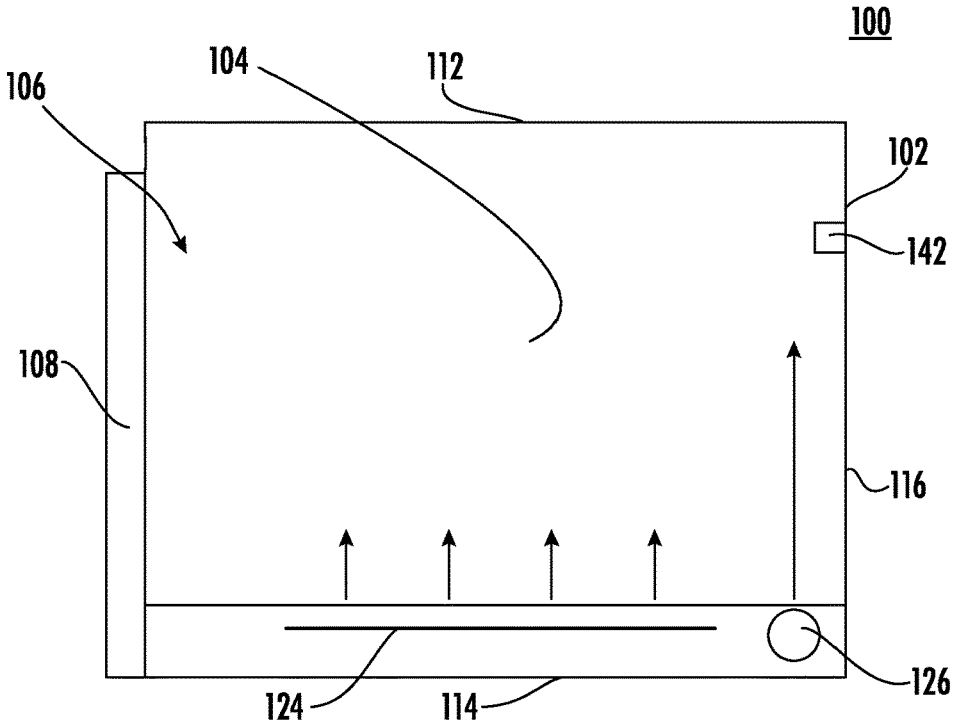
FIG. 2 provides a side schematic view of the exemplary oven appliance of FIG. 1.
Figure 3:
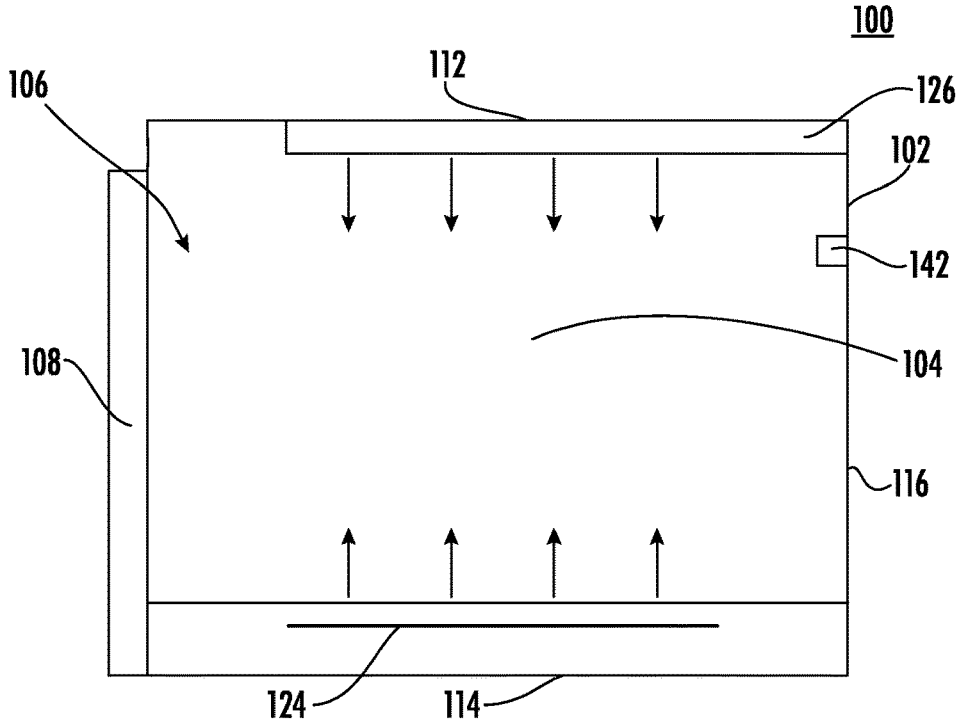
FIG. 3 provides a side schematic view of an oven appliance according to another exemplary embodiment.

Referring to FIGS. 1 through 3, for this exemplary embodiment, oven appliance 100 may include an insulated cabinet 102 with an interior cooking chamber 104 defined by a top wall 112, a bottom wall 114, a back wall 116, and a pair of opposing side walls. Cooking chamber 104 is configured for the receipt of one or more food items to be cooked. Oven appliance 100 includes a door 108 pivotally mounted, e.g., with one or more hinges (not shown), to cabinet 102 at the opening 106 of cabinet 102 to permit selective access to cooking chamber 104 through opening 106. As shown in FIG. 1, door 108 is in a closed position (i.e., cabinet 102 is sealed). A handle 110 may be mounted to door 108 to assist a user with opening and closing door 108. For example, a user can pull on handle 110 to open or close door 108 and access cooking chamber 104.

Oven appliance 100 may include a seal (not shown) between door 108 and cabinet 102 that assists with maintaining heat and cooking vapors within cooking chamber 104 when door 108 is closed as shown in FIGS. 1 and 2. Multiple parallel glass panes 122 provide for viewing the contents of cooking chamber 104 when door 108 is closed and assist with insulating cooking chamber 104.

One or more heating elements may be provided at the top, bottom, or both of cooking chamber 104, and may provide heat to cooking chamber 104 for cooking. Such heating element(s) can be gas, electric, microwave, or a combination thereof. For example, in the embodiment shown in FIG. 2, oven appliance 100 includes a first heating element 124 and a second heating element 126. Second heating element 126 may be incorporated in addition or alternatively to first heating element 124. First heating element 124 may be an electric heating element. Second heating element 126 may be a gas heating element. However, in some embodiments, first heating element 124 is a gas heating element and second heating element 126 is an electric heating element.

Each of first heating element 124 and second heating element 126 may be arranged in a variety of positions within oven appliance 100. In one example (FIG. 2), first heating element 124 is provided at or near a bottom of oven appliance 100 (e.g., at a bottom of cooking chamber 104 or underneath cooking chamber 104). Additionally or alternatively, second heating element 126 may be provided at or near a bottom rear portion of oven appliance 100 (e.g., at a bottom rear portion of cooking chamber 104). In some embodiments, first heating element 124 is provided at the bottom of oven appliance 100 while second heating element 126 is provided at a top of oven appliance 100 (FIG. 3). It should be understood that placements of first heating element 124 and second heating element 126 may vary according to specific and particular applications. For instance, first heating element 124 and/or second heating element 126 may be provided in various combinations, e.g., one top heating element with two or more bottom heating elements, two or more top heating elements 124, 126 with no bottom heating element, etc.

Oven appliance 100 may include a user interface 128 having a display 130 positioned on an interface panel 132 and having a variety of user input devices, e.g., controls 134. Interface 128 may allow the user to select various options for the operation of oven 100 including, e.g., various cooking and cleaning cycles. Operation of oven appliance 100 may be regulated by a controller 140 that is operatively coupled, i.e., in communication with, user interface 128, heating elements 124, 126, 136 and other components of oven 100 as will be further described.

For example, in response to user manipulation of the user interface 128, controller 140 may operate the heating element(s) 124 and/or 126. Controller 140 may receive measurements from one or more temperature sensors such as sensors described below. Controller 140 may also provide information such as a status indicator, e.g., a temperature indication, to the user with display 130. Controller 140 may also be provided with other features as will be further described herein. Oven appliance 100 may include a temperature sensor 142 provided within cooking chamber 104. Temperature sensor 142 may monitor the oven temperature within cooking chamber 104. For instance, temperature sensor 142 may take periodic temperature measurements within cooking chamber and transmit the measured temperatures to controller 140. Temperature sensor 142 may be an infrared sensor, a thermocouple, a resistance temperature detector, a thermistor, or the like. In some embodiments, temperature sensor 142 is provided in a location so as to measure an oven temperature at or near a center of cooking chamber 104. However, a location of temperature sensor 142 may vary according to specific applications.

Controller 140 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor. The memory may store information accessible by the processor(s), including instructions that can be executed by processor(s). For example, the instructions can be software or any set of instructions that when executed by the processor(s), cause the processor(s) to perform operations. For the embodiment depicted, the instructions may include a software package configured to operate the system to, e.g., execute the exemplary methods described below. Controller 140 may also be or include the capabilities of either a proportional (P), proportional-integral (PI), or proportional-integral-derivative (PID) control for feedback-based control implemented with, e.g., temperature feedback from one or more sensors.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128 otherwise within interface panel 132 or at any other appropriate location with respect to oven appliance 100. In the embodiment illustrated in FIG. 1, input/output ("I/O") signals are routed between controller 140 and various operational components of oven appliance 100 such as heating elements 124, 126, 136, convection fan 138, controls 134, display 130, alarms, and/or other components as may be provided. In one embodiment, user interface 128 may represent a general purpose I/O ("GPIO") device or functional block.

In the illustrated embodiments, the user input device is provided as touch type controls 134, however, it should be understood that controls 134 and the configuration of oven appliance 100 shown in FIG. 1 are illustrated by way of example only. For example, the user interface 128 may be provided as a touchscreen, which provides both the display 130 and the controls 134. As further examples, the user interface 128 may include various input components, such as one or more of a variety of electrical, mechanical, or electro-mechanical input devices including rotary dials, push buttons, and touch pads. User interface 128 may include other display components, such as a digital or analog display device designed to provide operational feedback to a user. In some embodiments, user interface 128 may be in communication with controller 140 via one or more signal lines or shared communication busses. In other embodiments, the user interface 128 may be configured as an external computing device or remote user interface device, such as a smart phone, tablet, or other device capable of connecting to the controller 140. For example, the remote user interface device may be a handheld user interface with a display thereon, e.g., a touchscreen display. The remote user device may connect to the controller 140 wirelessly using any suitable wireless connection, such as wireless radio, WI-FI®, BLUETOOTH®, ZIGBEE®, laser, infrared, and any other suitable device or interface. For example, in some embodiments, the remote user interface may be an application or "app" executed by a remote user interface device such as a smart phone or tablet. Signals generated in controller 140 may operate appliance 100 in response to user input via the user interface 128.

While oven 100 is shown as a wall oven, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the controls 134, as mentioned above, are possible. As another example, the oven appliance 100 may include multiple doors 108 instead of or in addition to the single door 108 illustrated. Such examples include a dual cavity oven, a French door oven, and others. The examples described herein are provided by way of illustration only and without limitation.

Figure 4:
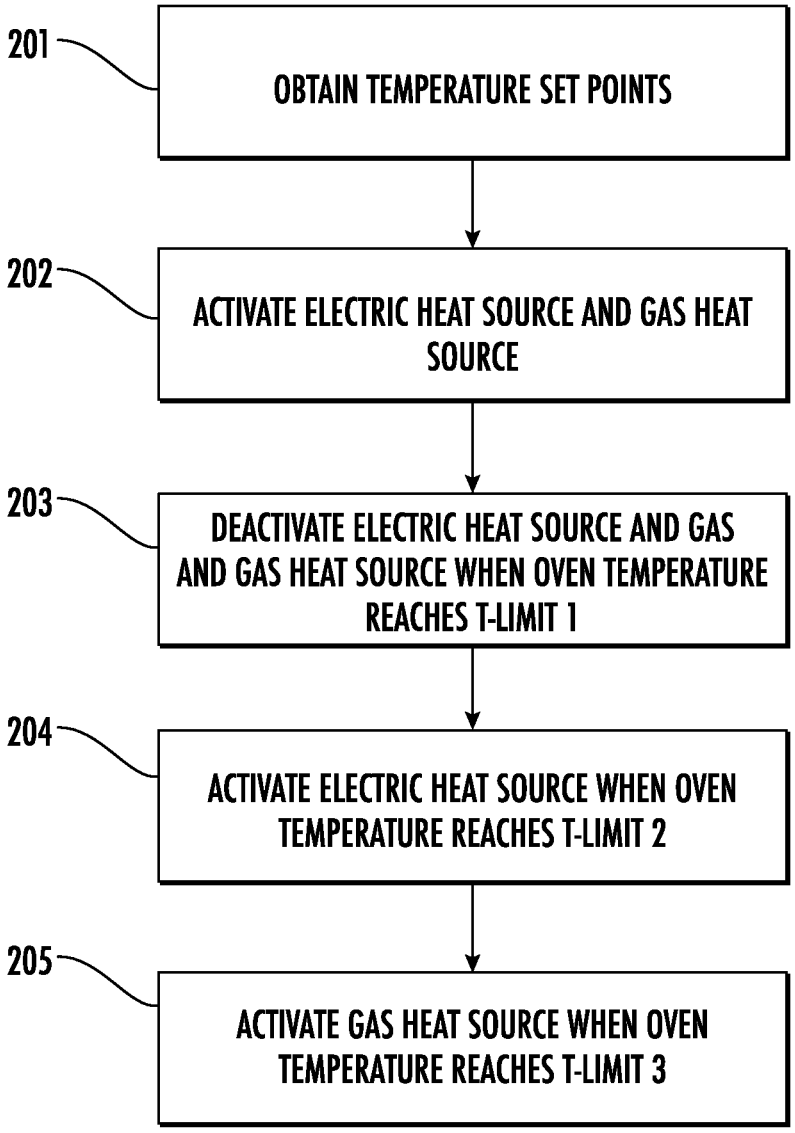
FIG. 4 provides a flow chart illustrating a method of operating an exemplary oven appliance.

A method 200 of operating an oven appliance (e.g., oven appliance 100) will now be described with particular reference to FIGS. 4 and 5. At the outset, a user may wish to perform a cooking operation. At step 201, the oven appliance may obtain a temperature set point. For instance, the user may enter in a desired temperature set point via a user interface (e.g., user interface 128). Additionally or alternatively, the temperature set point may be a predetermined or preprogrammed temperature stored in the oven appliance and associated with a particular operation. The temperature set point may be a temperature at which the oven appliance is to perform the cooking operation. Additionally or alternatively, the temperature set point may be a temperature at which the oven appliance is to perform a different operation, such as a cleaning operation, a warming operation, or the like.

At step 202, the method may include activating a gas heating element and an electrical heating element. For instance, after obtaining the temperature set point, the controller (e.g., controller 140) may activate each of the gas heating element and the electric heating element in order to provide heat to a cooking chamber (e.g., cooking chamber 104). Advantageously, by operating both the gas heating element and the electric heating element, the cooking chamber may reach the temperature set point more quickly.

The method may include determining an electric heating temperature range and a gas undershoot temperature limit. For instance, the electric heating temperature range may be a temperature range within which the electric heating element (e.g., first heating element 124) is operated. The operation of the electric heating element may include operating the electric heating element in a cyclical manner. In other words, within the electric heating temperature range, the electric heating element may be continually cycled on and off in order to maintain the oven temperature within the electric heating temperature range. In this regard, for example, the thermal loading required by an item within the cooking chamber may be such that the electric heating element is capable of maintaining the oven temperature near the temperature set point, i.e., within the electric heating temperature range, without needing support from the gas heating element.

Figure 5:
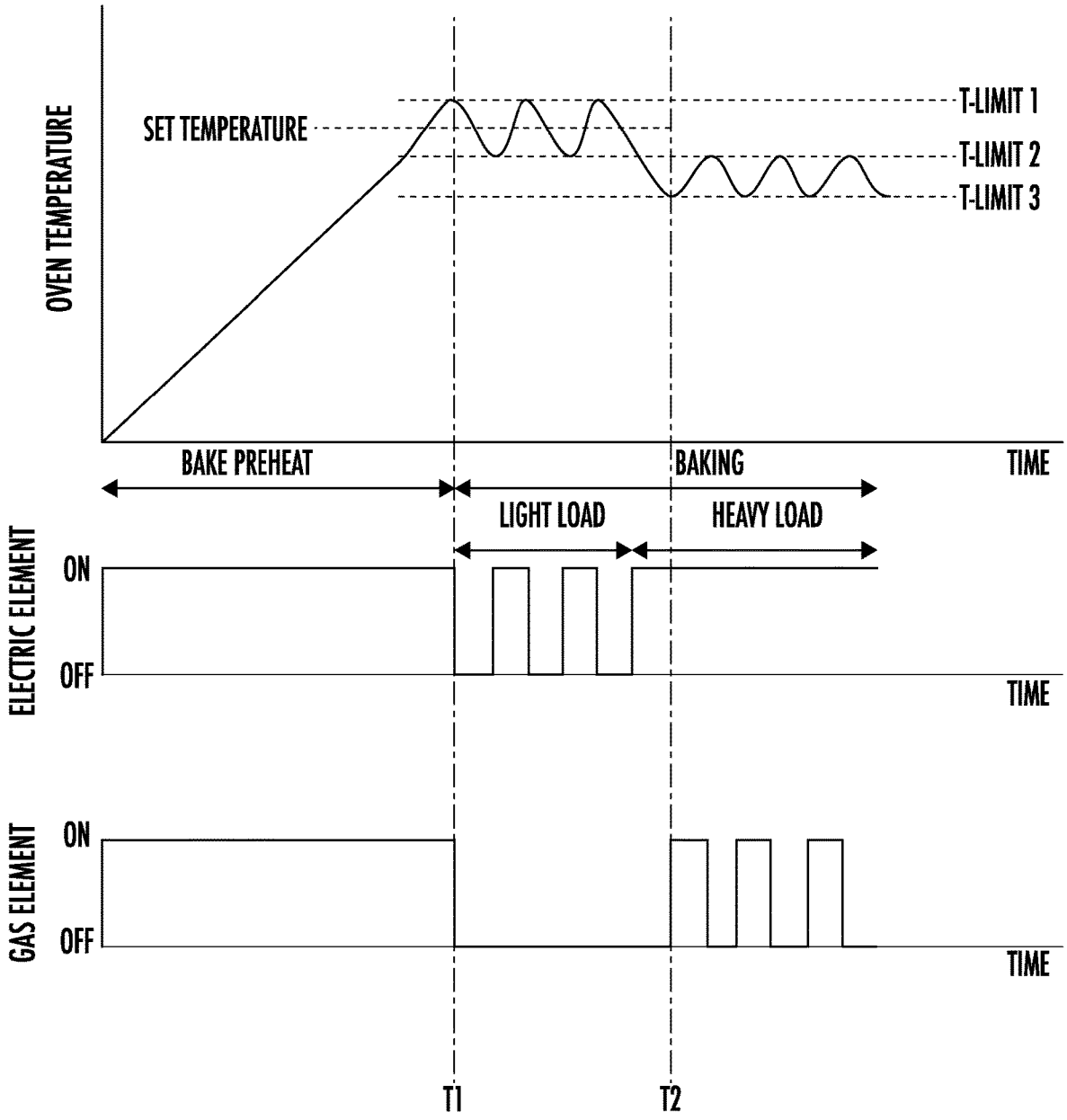
FIG. 5 provides a schematic view of the operation of the exemplary oven appliance of FIG. 1 implementing the exemplary method of FIG. 4, along with the corresponding temperature, according to an exemplary embodiment of the present subject matter.

As shown in FIG. 5, the electric heating temperature range may be bound by an electric overshoot temperature limit (T-limit 1) and an electric undershoot temperature limit (T-limit 2). The electric overshoot temperature limit T-limit 1 may be greater than the temperature set point, and the electric undershoot temperature limit T-limit 2 may be less than the temperature set point. Accordingly, the temperature set point may be within the electric heating temperature range (i.e., between electric overshoot temperature limit T-limit 1 and electric undershoot temperature limit T-limit 2). For example, T-limit 1 is greater than the temperature set point, while T-limit 2 is less than the temperature set point.

In detail, at step 203, when the oven temperature reaches T-limit 1 (e.g., at time point Ti in FIG. 5), the gas heating element and the electric heating element may be deactivated (i.e., turned off). In some embodiments, the gas heating element is turned off before the electric heating element is turned off (e.g., at electric undershoot temperature limit T-limit 2). Accordingly, the oven temperature may begin to fall as each of the electric heating element and the gas heating element provide less heat to the cooking chamber. At step 204, when the oven temperature then reaches T-limit 2, the electric heating element may be activated. However, the gas heating element may remain deactivated. Thus, as the temperature fluctuates within the electric heating temperature range (e.g., between T-limit 1 and T-limit 2), only the electric heating element may be cycled between an activated state and a deactivated state. In other words, as the temperature fluctuates within the electric heating temperature range, the electric heating element is cycled.

In some embodiments, a heavy load requirement or other unforeseen circumstances may lead to a drop in oven temperature below T-limit 2. In detail, the oven temperature may drop below T-limit 2 while the electric heating element is still activated. In this case, at step 205, when the oven temperature reaches the gas undershoot temperature limit (T-limit 3), the gas heating element may be activated. The gas undershoot temperature limit T-limit 3 may be less than the electric temperature undershoot limit. Accordingly, when the oven temperature reaches the gas undershoot temperature limit T-limit 3, the gas heating element may be activated. Thus, both the electric heating element and the gas heating element may be activated simultaneously to provide extra heat to the cooking chamber when needed.

In detail, under the heavy load for example, the electric heating element may remain activated (e.g., on and producing heat) when the oven temperature is below the electric undershoot temperature limit T-limit 2. The gas heating element may then be cycled while the electric heating element remains activated. In other words, the gas heating element may be turned on when the oven temperature reaches the gas undershoot temperature limit T-limit 3. The gas heating element may then be deactivated when the oven temperature reaches the electric undershoot temperature limit T-limit 2. This cycling may continue for a predetermined period of time as the heavy load is monitored (i.e., the oven temperature is monitored). In some embodiments, the gas heating element may be activated until the oven temperature reaches the electric overshoot temperature limit T-limit 1, at which point the gas heating element is deactivated. At this point, the electric heating element may continue a cycling operation (e.g., between an activated state and a deactivated state) while the oven temperature remains in the electric heating temperature range.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an oven appliance, the oven appliance comprising a cooking chamber, a gas heat source, and an electric heat source, the method comprising:

obtaining a temperature set point via a user input;

determining, using one or more computer processing units and based on the temperature set point, an electric heating temperature range and a gas undershoot temperature limit, the gas undershoot limit being below the electric heating temperature range, wherein the temperature set point is within the electric heating temperature range;

activating the gas heat source and the electric heat source to reach the temperature set point;

deactivating the gas heat source and cycling the electric heat source between an active state and an inactive state upon reaching the temperature set point;

determining, using the one or more computer processing units, that a chamber temperature has dropped to the gas undershoot temperature limit; and operating the gas heat source to maintain the chamber temperature above the gas undershoot temperature limit, wherein the gas heat source is cycled between an active state and an inactive state while the electric heat source is maintained in an active state.

2. The method of claim 1, wherein the electric heating temperature range comprises an electric overshoot temperature limit above the temperature set point and an electric undershoot temperature limit below the temperature set point.

3. The method of claim 2, further comprising cycling the electric heat source to maintain the chamber temperature within the electric heating temperature range.

4. The method of claim 3, wherein the cycling of the electric heat source comprises activating the electric heat source in response to the chamber temperature reaching the electric undershoot temperature and deactivating the electric heat source in response to the chamber temperature reaching the electric overshoot temperature.

5. The method of claim 2, wherein operating the gas heat source to maintain the chamber temperature above the gas undershoot limit comprises activating the gas heat source in response to the chamber temperature reaching the gas undershoot limit and deactivating the gas heat source in response to the chamber temperature reaching the electric undershoot temperature.

6. The method of claim 1, wherein the oven appliance further comprises a temperature sensor located inside the cooking chamber and configured to sense the temperature inside the oven appliance.

7. The method of claim 6, further comprising a controller operably connected to the electric heat source, the gas heat source, and the temperature sensor, wherein the controller is configured to operate the gas heat source and the electric heat source.

8. The method of claim 1, wherein obtaining the temperature set point comprises receiving an input from a user via a user interface.

9. The method of claim 1, wherein the electric heat source is provided at a bottom of the cooking chamber and the gas heat source is provided at a top of the cooking chamber.

10. The method of claim 1, wherein the electric heat source is provided at a bottom of the cooking chamber and the gas heat source is provided at a rear of the cooking chamber.

11. An oven appliance, comprising:

a cabinet defining a cooking chamber;

an electric heat source provided within the cooking chamber;

a gas heat source provided within the cooking chamber;

a temperature sensor provided within the cooking chamber and configured to sense a temperature of the cooking chamber; and a controller operably connected to the electric heat source, the gas heat source, and the temperature sensor, wherein the controller is configured to execute an operation comprising:

obtaining a temperature set point;

determining, based on the temperature set point, an electric heating temperature range and a gas undershoot temperature limit, the gas undershoot limit being below the electric heating temperature range;

performing a first heating operation comprising operating each of the electric heat source and the gas heat source;

deactivating the gas heat source and cycling the electric heat source between an activated state and a deactivated state when a chamber temperature has reached the temperature set point;

determining that the chamber temperature has dropped to the gas undershoot temperature limit; and operating the gas heat source to maintain the chamber temperature above the gas undershoot temperature limit.

12. The oven appliance of claim 11, wherein the electric heating temperature range comprises an electric overshoot temperature limit above the temperature set point and an electric undershoot temperature limit below the temperature set point.

13. The oven appliance of claim 12, wherein the operation further comprises cycling the electric heat source to maintain the chamber temperature within the electric heating temperature range during a second heating operation.

14. The oven appliance of claim 13, wherein the cycling of the electric heat source comprises activating the electric heat source in response to the chamber temperature reaching the electric undershoot temperature and deactivating the electric heat source in response to the chamber temperature reaching the electric overshoot temperature.

15. The oven appliance of claim 12, wherein operating the gas heat source to maintain the chamber temperature above the gas undershoot limit comprises activating the gas heat source in response to the chamber temperature reaching the gas undershoot limit and deactivating the gas heat source in response to the chamber temperature reaching the electric undershoot temperature.

16. The oven appliance of claim 11, wherein obtaining the temperature set point comprises receiving an input from a user via a user interface.

17. The oven appliance of claim 11, wherein the electric heat source is provided at a bottom of the cooking chamber and the gas heat source is provided at a top of the cooking chamber.

18. The oven appliance of claim 11, wherein the electric heat source is provided at a bottom of the cooking chamber and the gas heat source is provided at a rear of the cooking chamber.

* * * * *